US005964503A

United States Patent [19]

Inoue

[11] Patent Number: 5,964,503

[45] Date of Patent: Oct. 12, 1999

[54] CHAIR

[75] Inventor: Noboru Inoue, Tokyo, Japan

[73] Assignee: Inoue Associates, Inc., Japan

[21] Appl. No.: 08/916,403

[22] Filed: Aug. 22, 1997

[30] Foreign Application Priority Data

Apr. 28, 1997 [JP] Japan ..... 9-122851

[51] Int. Cl.[6] ..... A47C 3/00

[52] U.S. Cl. ..... 297/300.4; 297/300.1; 297/303.3

[58] Field of Search ..... 297/300.4, 300.5, 297/300.1, 300.2, 303.3, 303.4, 300.3

[56] References Cited

U.S. PATENT DOCUMENTS

| | | | |
|---|---|---|---|
| 4,709,962 | 12/1987 | Steinmann | 297/300.5 X |
| 4,761,033 | 8/1988 | Lanuzzi et al. | 297/300.5 X |
| 4,830,431 | 5/1989 | Inoue | 297/300.5 |
| 4,966,411 | 10/1990 | Katagirl et al. | 297/300.5 X |
| 5,308,144 | 5/1994 | Korn | 297/300.2 |
| 5,584,533 | 12/1996 | Schrewe | 297/300.4 X |
| 5,658,045 | 8/1997 | Van Koolwijk et al. | 297/300.5 |

*Primary Examiner*—Peter M. Cuomo
*Assistant Examiner*—Stephen Vu
*Attorney, Agent, or Firm*—Rogers & Killeen

[57] ABSTRACT

A chair having concurrently operative function between a seat and a backrest is disclosed which has a simple structure and is capable of exhibiting smooth motion and which has enhanced degree of freedom in its design because of the simple structure. The chair comprises a shallow box-like base member 2 mounted on an upper portion of a support pillar 1 and forward protruding below a front half of a seat; link members 3, 4 back-and-forth swingably provided on right and left front ends of the base member 2, the link members 3, 4 extending upward; and a swing member 6 having its front ends pivotally attached to the base member 2 at an intermediate position of the base member 2 in front of the support pillar 1 by means of a horizontal shaft 7 in the presence of a torsion coil spring 8, the swing member 6 having a portion **6*k*, 6*j* extending substantially right upward at its rear end, to the substantially upright portion 6*k*, 6*j* being attached a backrest, the swing member being provided with seat supporting portions 6*f*, 6*g* behind the intermediate pivotal point so as to support a seat frame 11 by the link members 3, 4 and the seat supporting portions 6*f*, 6*g*. In the chair, the seat supporting portions 6*f*, 6*g* provided on the swing member 6 are so formed as to upward extend from the upper surface of the swing member 6; the seat frame 11 has a contour in plan which substantially corresponds to outline of the seat and which is substantially rectangular or substantially circular when viewed in plan; the seat frame 11 is provided in its bottom surface with tongue-shaped support parts 11*a*–11*d* downward extending therefrom, and lower portions of the support parts are connected to upper end portions of the link members 3, 4 by means of a horizontal shaft 12 and lower portions of the rest of the support parts are connected to upper portions of the seat supporting portions by means of horizontal shafts 13*a*, 13*b* to thereby support the seat frame 11 at a distance from the upper surfaces of the base member 2 and the swing member 6**.

1 Claim, 5 Drawing Sheets

CHAIR

BACKGROUND OF THE INVENTION

1. Field of the Invention

The present invention relates to a chair utilizing concurrence between descent of a seat and back-and-forth swing motion of a backrest, which is preferably used, in particular, as a revolving office chair.

2. Prior Art

Heretofore, various types of chairs have been proposed which are so constructed as to utilize concurrence between descent of a seat and back-and-forth swing motion of a backrest, and some of them have been practically used.

Such conventional chairs, however, which utilize concurrence between descent of a seat and back-and-forth swing motion of a backrest, inevitably have complicated structures due to their functions. Accordingly, most of the chairs having such functions and structures have their operative portions entirely covered with so-called outer shells.

When a chair has its seat bottom and backrest rear covered with an outer shell made of a synthetic resin, the chair has an awkwardly thick profile, in particular, in a portion below the seat, thereby leading to lack of lightness. Further, the chair is disadvantageously restricted in its design owing to the seat bottom and the backrest being entirely covered with the outer shell. In addition, it has a complicated structure and constituent members thereof are densely arranged. Consequently, manufacture thereof is, of course, not easy and yet maintenance thereof is not easy.

SUMMARY OF THE INVENTION

The present invention has been made in view of the above-described state of chairs of a type utilizing concurrent operation between a seat and a backrest It is, therefore, an object of the present invention to provide a chair having concurrently operative function between a seat and a backrest, which has a simple structure and is capable of exhibiting smooth motion, and which has enhanced degree of freedom in its design because of the simple structure.

To solve the above problems, according to the present invention, there is provided a chair comprising:

a shallow box-like base member mounted on an upper portion of a support pillar and forward protruding below a front half of a seat, link members back-and-forth swingably provided on right and left front ends of the base member, the link members extending upward, and a swing member having its front ends pivotally attached to the base member at an intermediate position of the base member in front of the support pillar by means of a horizontal shaft in the presence of a torsion coil spring, the swing member having a portion extending substantially right upward at its rear end, to the substantially upright portion being attached a backrest, the swing member being provided with seat supporting portions behind the intermediate pivotal point so as to support a seat frame by the link members and the seat supporting portions, wherein the seat supporting portions provided on the swing member are so formed as to upward extend from the upper surface of the swing member; the seat frame has a contour in plan which substantially corresponds to outline of the seat and which is substantially rectangular or substantially circular when viewed in plan; the seat frame is provided in its bottom surface with tongue-shaped support parts downward extending therefrom, and lower portions of the support parts are connected to upper end portions of the link members by means of a horizontal shaft and lower portions of the rest of the support parts are connected to upper portions of the seat supporting portions by means of horizontal shafts to thereby support the seat frame at a distance from the upper surfaces of the base member and the swing member.

DESCRIPTION OF THE PREFERRED EMBODIMENT

Figure 1:
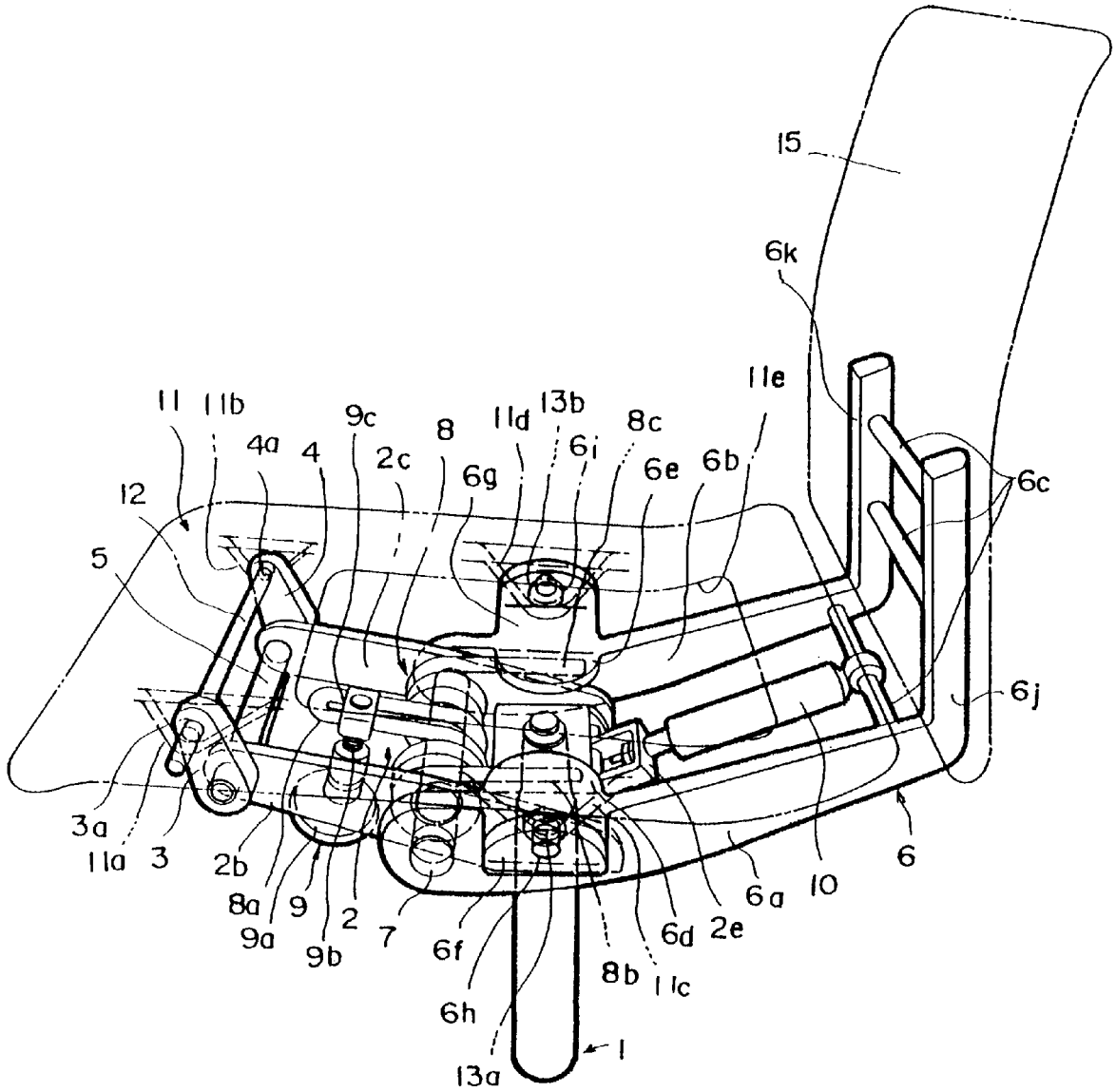
FIG. 1 is a perspective view of a main portion of an embodiment of the chair according to the present invention.
Figure 2:
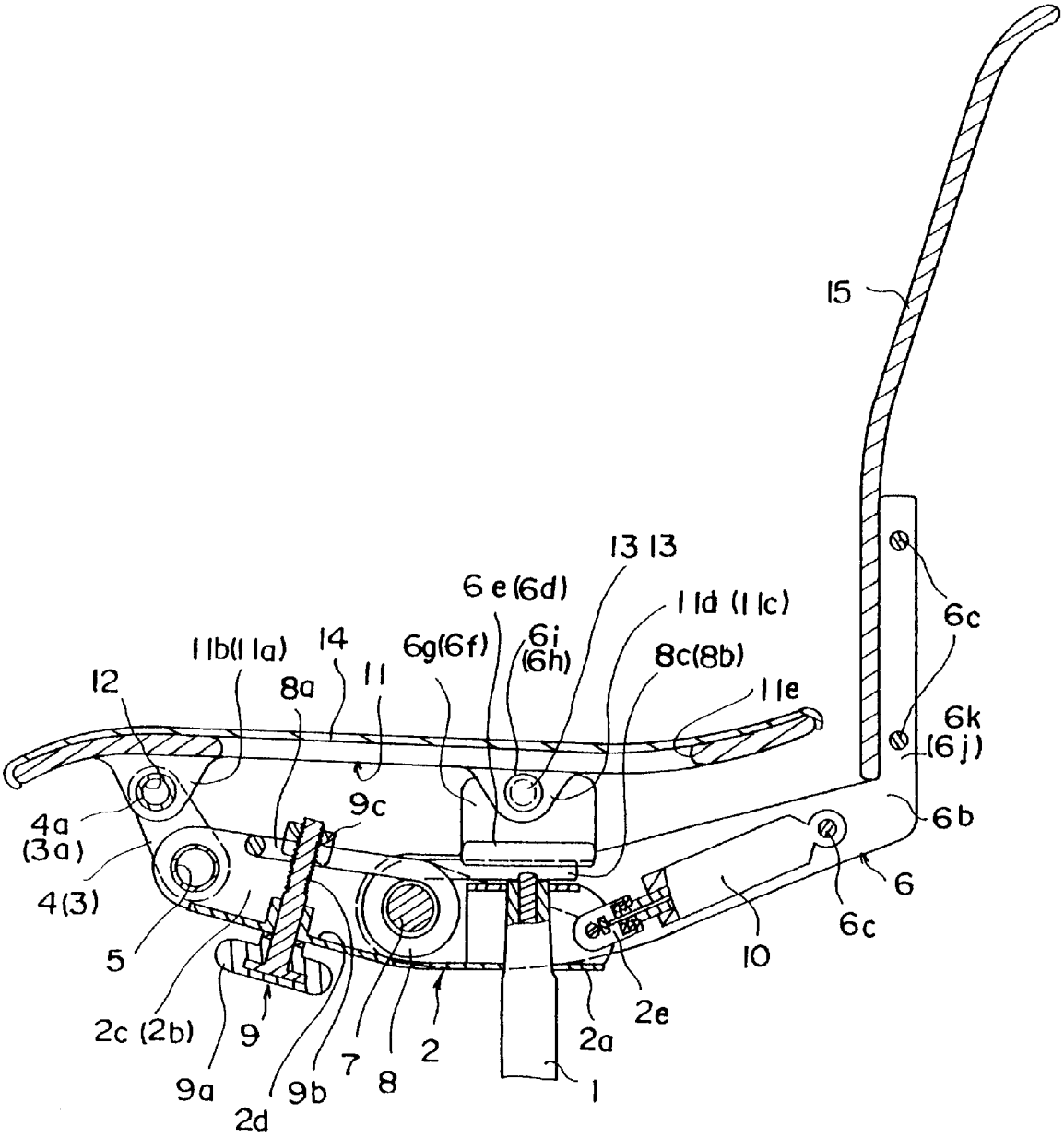
FIG. 2 is a side view of the chair in FIG. 1 in vertical section.
Figure 3:
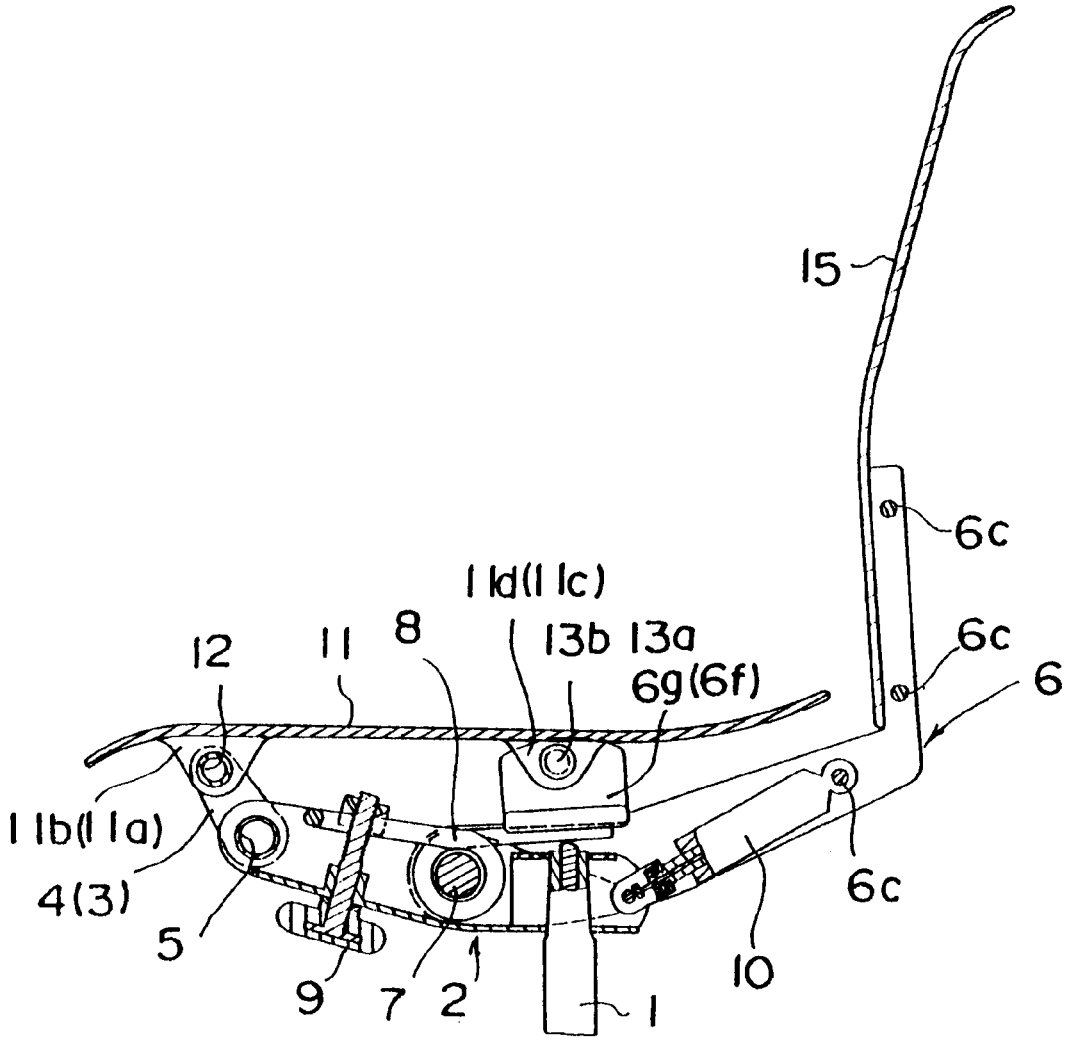
FIG. 3 is a side view of the chair in FIGS. 1 and 2 showing 1st example of posture changes.
Figure 4:
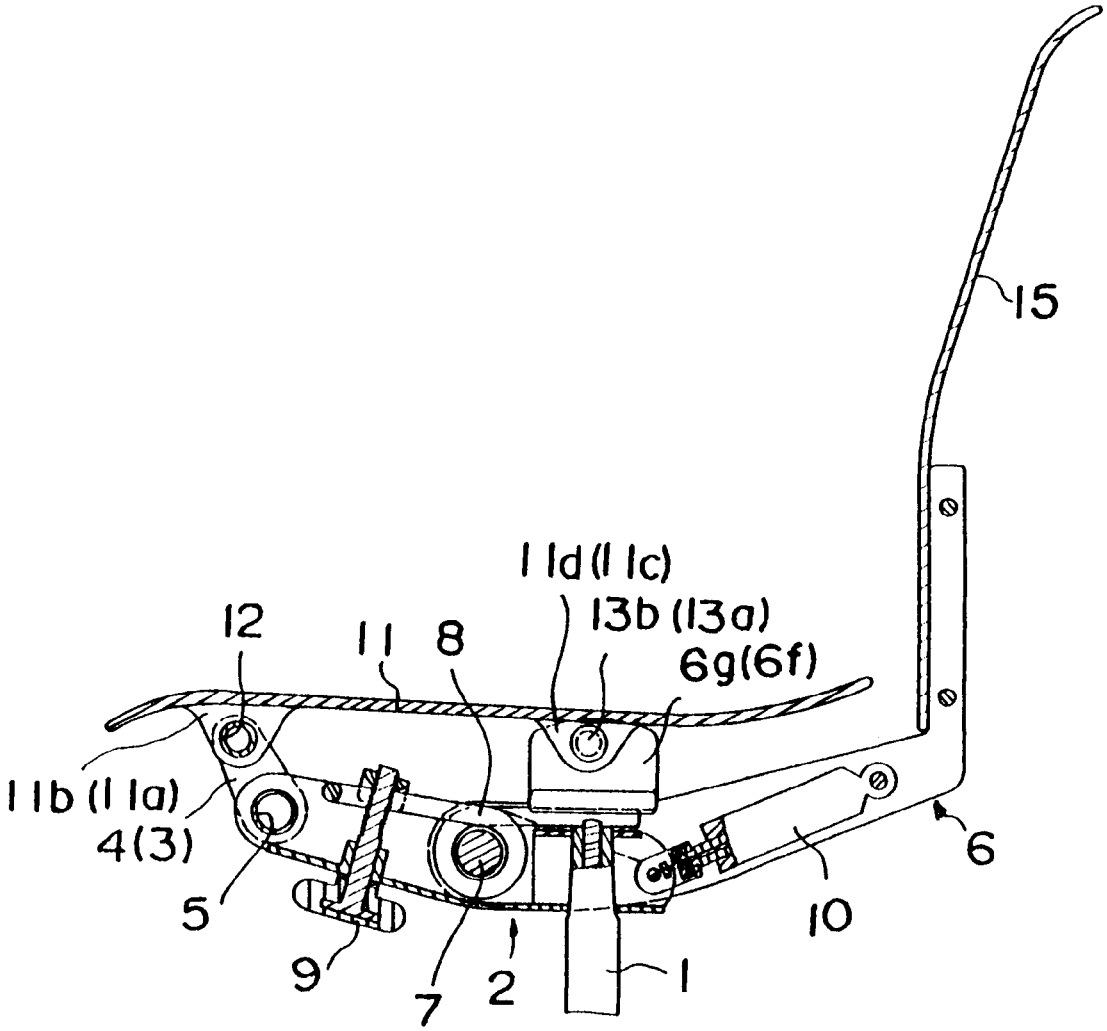
FIG. 4 is a side view of the chair in FIGS. 1 and 2 showing 2nd example of posture changes.
Figure 5:
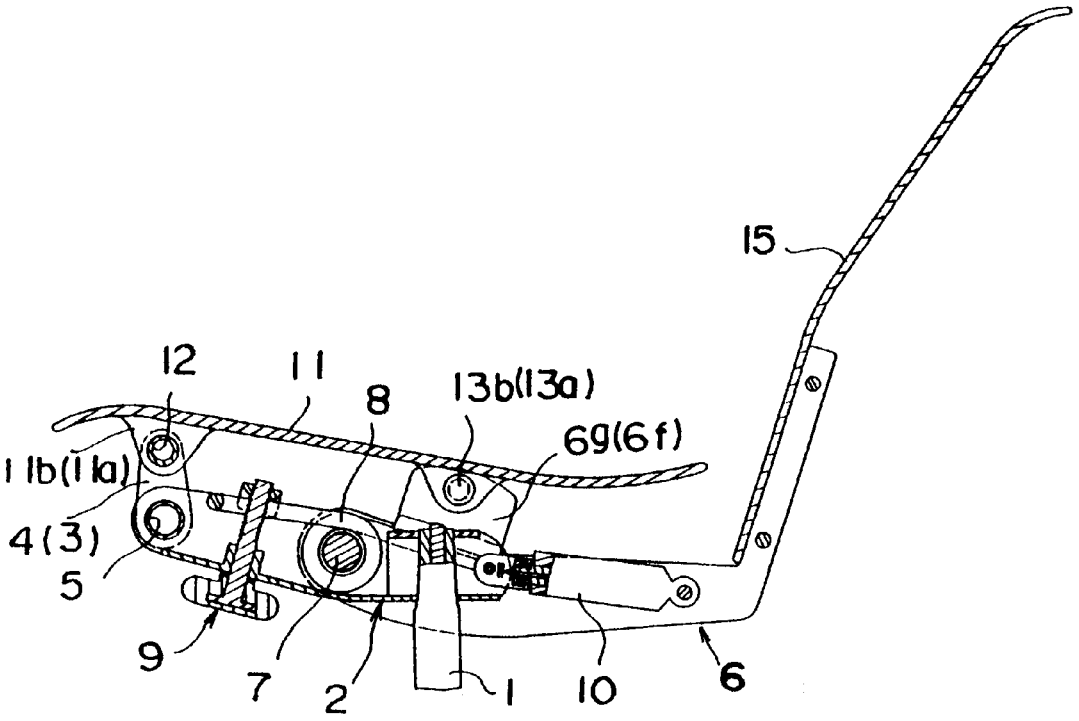
FIG. 5 is a side view of the chair in FIGS. 1 and 2 showing 3rd example of posture changes.

In the following, an embodiment of the present invention will be described with reference to the accompanying drawings. FIG. 1 is a perspective view structurally showing the characteristic portion of the chair according to the present invention. FIG. 2 is a vertical sectional side view of the chair in FIG. 1. FIGS. 3 to 5 are vertical sectional side views showing in varied postures of the chair in FIGS. 1 and 2.

In FIGS. 1 to 5, reference number 1 indicates a support pillar of the chair, which has an asteroid or disk-like pedibase (not shown) at its lower end. The support pillar 1 may or may not be of a height-adjustable type.

Reference number 2 is a base member rotatably or unrotatably mounted on the upper end of the support pillar 1. The base member 2 has a staple-like U-shape in the front view and a rectangular mouth-shape in the rear view. The base member 2 is mounted on the support pillar 1 with the upper end of the support pillar 1 inserted into a double-wall portion 2*a* at the rear of the base member 2. If the base member 2 is unrotatably mounted on the upper end of the support pillar 1, the base member 2 and the support pillar 1 are together rotatably supported by a support pillar holder (not shown).

Reference numbers 3 and 4 represent link members provided at the front end of base member 2. These link members 3 and 4 are pivotally attached to right and left vertical walls 2*b* and 2*c*, respectively, at their lower end portions by means of a shaft 5. The link members 3, 4 are provided with pin holding holes 3*a*, 4*a* in their upper end portions, respectively.

Reference number 6 represents a swing member having a front half in the form of a pair of lever-shaped portions for externally holding the right and left vertical walls 2*b* and 2*c* of the base member 2 and a rear half extending substantially right upward. The right and left substantially horizontal lever portions 6*a* and 6*b* are connected by link members 6*c* to form a fork-like structure. The front ends of the lever portions 6*a*, 6*b* are pivotally attached to the vertical walls 2*b*, 2*c* of the base member 2 by means of a horizontal shaft 7.

The swing member 6 is provided with small wing members 6*d*, 6*e* in its right and left lever portions 6*a*, 6*b* behind the pivotal points by means of the pivot shaft 7 and, in the illustrated embodiment, substantially right above the support pillar 1, respectively. Outer portions of the wing members 6*d* and 6*e* are bent upward to form vertical wall portions 6*f* and 6*g*, respectively. In the vertical wall portions 6*f* and 6*g*, pin holding holes 6*h* and 6*i* are formed, respectively. The vertical wall portions 6*f*, 6*g* of the swing member 6 and the above-described link members 3, 4 together function as a mounting support for a seat frame described below.

Reference number 8 represents a torsion coil spring with its coiled portion fitted on the pivot shaft 7 pivotally mounting the swing member 6 on the base member 2. The torsion coil spring 8 has its front end 8*a* supported by spring adjusting means 9 attached to the base member 2, and has its two rear ends 8*b* and 8*c* supported by the bottom face of the wing portions 6*d* and 6*e* formed in the lever portions 6*a* and 6*b*, respectively. By the action of the spring 8, the swing member 6 is always biased relative to the pivot shaft 7 in the counterclockwise direction in FIGS. 1 and 2.

The spring force adjusting means 9 comprises a screw rod 9*b* having a knob 9*a* at its lower end and a pressing piece 9*c*. A threaded portion of the screw rod 9*b* is screwed into the pressing piece 9*c* to press the front end 8*a* of the spring 8 against the pressing piece 9*c*. The distance between the front end 8*a* of the spring 8 and a bottom plate 2*d* is adjusted by rotating the knob 9*a*, thereby adjusting the pressing force of the rear ends 8*b* and 8*c* of the spring 8 against wing portions 6*d* and 6*e*.

Reference number 10 represents a gas cylinder bridgewise disposed between the lowermost link member 6*c* of the swing member 6 and the rear end of the base member 2. The gas cylinder 10 is provided to fix an inclination angle resulting from swing of the swing member 6. For this purpose, the gas cylinder is equipped with a valve in its inner gas passage (not shown). The valve is of such a type that it is open so as to permit the gas cylinder 10 to freely extend/retract when the swing member 6 is permitted to freely swing, and that it is closed only when the swing member 6 is locked. Referential representation 2*e* denotes a rod-connecting bracket which is pivotally attached to the rear end of the base member 2 to connect a piston rod of the gas cylinder 10. The above-described members 2–10 constitute a swing mechanism of the chair according to the present invention. It is to be noted that the chair of the present invention may be of a type which is not provided with a gas cylinder 10.

Reference number 11 represents a seat frame of a substantially rectangular shape when viewed in plan, which is pivotally supported by the swing mechanism. Specifically, the seat frame 11 is pivotally supported by means of a spanning shaft 12 and pin-like shafts 13*a* and 13*b* which are received by the shaft receiving holes 3*a* and 4*a* of the link members 3 and 4 and the shaft receiving holes 6*h* and 6*i* in the vertical wall portions 6*f* and 6*g*, respectively. The seat frame 11 is provided in its bottom surface with front support pieces 11*a* and 11*b* and rear support pieces 11*c* and 11*d*, which are vertically formed at positions corresponding to the shaft 12 and the pin-like shafts 13*a* and 13*b*, respectively. The seat frame 11 has an inner hole 11*e* having a shape similar to the outline of the seat frame 11. In this embodiment, the seat frame 11 is substantially rectangular and has a hole 11*e*. However, the seat frame 11 of the chair according to the present invention may have a shape other than such a substantially rectangular shape and may be, for example, circular, when viewed in plan. Further, the seat frame 11 may be of a plain type having no hole 11*e*.

Reference number 14 represents a seat plate provided over the top of the seat frame 11 having the hole, which is made of, for example, a wire mesh, a synthetic resin board, or a plywood board. Reference number 15 represents a frame-like backrest which has an inner hole as in the seat frame 11 and which is attached to the front surfaces of the substantially upright portions 6*j* and 6*k* of the swing member 6. The backrest frame 15 is covered with a backrest plate made of the same material as or a material similar to that of the seat plate 14. The members from the pillar 1 to the backrest plate attached to the backrest frame 15 constitute an embodiment of the chair of the present invention. If the seat frame 11 is of a plain type having no hole 11*e*, the seat plate 14 may be made of a cushion material covered with a covering. In this case, arrangement may be made such that the seat frame 11 functions as an inner shell The backrest plate attached to the backrest frame 15 also may be of such a cushioned type.

The above-described chair according to the present invention is substantially the same as conventional chairs of this type in that when a person sits on the seat plate 14, the swing member 6 is pivotally moved on the pivot shaft 7 by the weight of the person to cause rearward descent of the swing member 6, and concurrently therewith, the backrest plate 15 is inclined backward.

In the chair of the present invention, however, the right and left linking members 3 and 4 upward extending from the front end potion of the base member 2 and the vertical wall portions 6*f* and 6*g* vertically provided on the upper surface of the swing member 6 behind the shaft 7, as the seat frame supporting members in the swing mechanism, and the four support pieces 11*a*–11*d* vertically provided in the bottom of the seat frame 11 at positions corresponding to those of the seat frame supporting members, are linked together by means of the shaft 12 and the pin-like shafts 13*a* and 13*b*. Accordingly, the seat frame 11 and the seat plate 14 mounted on the seat frame 11 are supported at a sufficient distance from the upper surfaces of the base member 2 and the swing member 6 as main members of the swing mechanism.

The sufficient amount of distance between the seat frame 11/the seat plate 14 and the base member 2/the swing member 6 enables a design of a chair which comprises a swing mechanism and, separated therefrom, a seat frame with a seat plate to be readily realized. It is, therefore, possible to create original designs which have not been found in conventional chairs of this type.

In particular, according to the illustrated embodiment of the chair of the present invention, the base member 2 and a front half of the swing member 6 are suspended from the seat frame 11 via the support pieces 11*a*–11*d*. By virtue of this, it is possible to further emphasize the originality of the design. Further, the seat frame 11 having a hole is carried above the swing mechanism. Accordingly, good cushioning properties can be obtained by simply using a thin plate, a netting or the like as the seat plate.

In the chair of the present invention, the front end of the seat frame 11 is shifted concurrently upward and rearward by swing action of the upward extending link members 3 and 4 at the time of rearward descent of the seat frame 11. By virtue of this, so-called ankle-tilt function is allowed to exhibit satisfactorily and smoothly. The inclination of the chair which fits with ankle-tilted posture can be fixed at a desired angle, if the chair is equipped with a gas cylinder 10.

The chair of the present invention is as described above, and accordingly, it is extremely useful as a chair, in particular as a revolving office chair, which has a seat and a backrest that concurrently operate. The structure capable of exhibiting the above-described functions is very simple. In particular, the seat frame and the swing mechanism are spaced, and no inner shell is required. This results in enhanced degree of freedom in design of the chair. Accordingly, the chair of the present invention has advantage that it can be manufactured with ease at a low cost.

What is claimed is:

1. A chair comprising:

a shallow base member mounted on an upper portion of a support pillar extending below a front half of a seat;

a pair of moveable link members provided respectively on right and left front ends of the base member, said link members extending vertically relative to the support pillar;

a swing member having a pair of front ends pivotally attached to the base member at an intermediate position of the base member in front of the support pillar by a horizontal shaft means having a torsion coil spring, said swing member having a pair of upright portions at a rear end, said upright portions being attached to a backrest, said swing member having seat supporting portions behind an intermediate pivotal point in order to support a seat frame with said link members and said seat supporting portions;

wherein the seat supporting portion provided on the swing member are formed to extend vertically from an upper surface of said swing member; the seat frame having a bottom surface with tongue-shaped support parts extending downwardly therefrom, and lower portions of the support parts are connected to upper end portions of the link members by said horizontal shaft means and lower portions of the rest of the support parts are connected to upper portions of the seat supporting portions by said horizontal shaft means to thereby support the seat frame at a minimum spaced distance above the upper surfaces of the base member and the swing member;

wherein said seat frame is a ring-shaped frame having a seat member manufactured from the group consisting of a netting material and a thin plate; and wherein said seat supporting portions include two opposing vertical wall portions extending vertically from the upper surface of said swing member in a coplanar relationship to said pillar.

* * * * *